United States Patent [19]

Pettersson

[11] 3,964,123

[45] June 22, 1976

[54] DEVICE FOR A COMBINED SUCTION AND BLOW-OFF NOZZLE CONNECTABLE TO A SOURCE OF COMPRESSED AIR

[76] Inventor: Henry A. Pettersson, Kvarngatan 7, S-811 Sandviken, Sweden

[22] Filed: July 3, 1974

[21] Appl. No.: 485,533

[30] Foreign Application Priority Data

July 13, 1973 Sweden ..... 7309869

[52] U.S. Cl. ..... 15/345; 15/409

[51] Int. Cl.[2] ..... A47L 5/14

[58] Field of Search ..... 15/345, 346, 409; 137/625.11, 625.42, 625.48, 627

[56] References Cited

UNITED STATES PATENTS

| | | | |
|---|---|---|---|
| 1,729,093 | 9/1929 | Baker | 15/409 X |
| 1,984,359 | 12/1934 | Bridgham | 15/409 X |
| 2,061,032 | 11/1936 | Huff | 15/409 X |
| 3,683,446 | 8/1972 | Tell | 15/409 X |

FOREIGN PATENTS OR APPLICATIONS

| | | | |
|---|---|---|---|
| 1,022,770 | 1/1958 | Germany | 15/409 |

*Primary Examiner*—Leonard D. Christian
*Assistant Examiner*—C. K. Moore
*Attorney, Agent, or Firm*—Ulle C. Linton

[57] ABSTRACT

The present invention relates to a device for a combined suction and blow-off nozzle connectable to a source of compressed air, which also includes means to collect particles in case the nozzle is used as a suction nozzle.

7 Claims, 2 Drawing Figures

Figure 1:
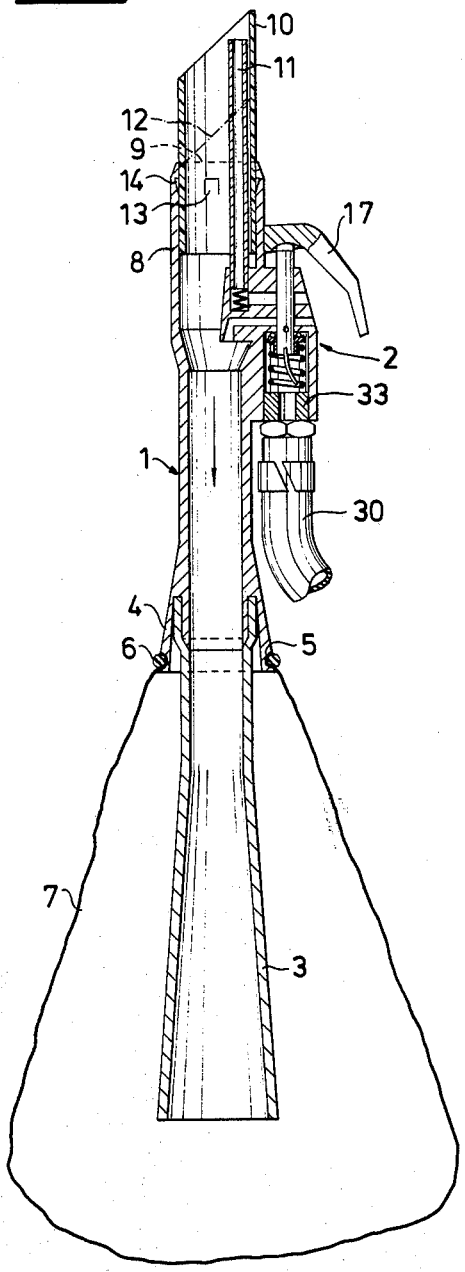

DEVICE FOR A COMBINED SUCTION AND BLOW-OFF NOZZLE CONNECTABLE TO A SOURCE OF COMPRESSED AIR

In the mechanical industry and other industries cleaning of the details in cutting operations as well as in assembling and other operation steps is often required. Such cleaning is often accomplished by clean blowing since at this moment, there are no devices fulfilling the requirements of the industry for a more suitable cleaning assembly, i.e. a device which is as easy to handle as a pneumatic gun and having all the advantages of such a gun and which at the same time may be used as a vacuum cleaner. Such a cleaning assembly eliminates the disadvantages encountered in clean blowing to the greatest extent possible. By the use of a cleaning assembly with suction action dust and other particles may primarly be sucked and thus, do not cause damages by the particles blown into the sensitive machine details. Only secondly, the cleaning assembly are used as clean blowing assembly. However, a combined nozzle for blowing as well as suction action has previously been proposed, but this nozzle has a number of disadvantages, among which the most prominent is that the change from blowing to vacuum cleaning is relatively complicated and uncertain since a separate operating means must be operated and because the valve structure of the previously known nozzle works in an unsatisfactory manner. Also, the previously known nozzle is unwieldy in its structure and have the means for collecting the sucked particles placed in such a manner that the nozzle becomes relatively hard to handle by the use thereof especially in narrow spaces.

The disadvantages mentioned above and other shown by hitherto known combined suction and blow-off nozzles are effectively eliminated by the device according to the present invention characterized as disclosed in the following claims. At the same time, such a device is obtained at low production costs and the parts of the valve mechanism are easily replaceable in case of failure.

The invention will be further described with reference to the accompanying drawing, which shows an exemplifying embodiment of the invention.

Figure 2:
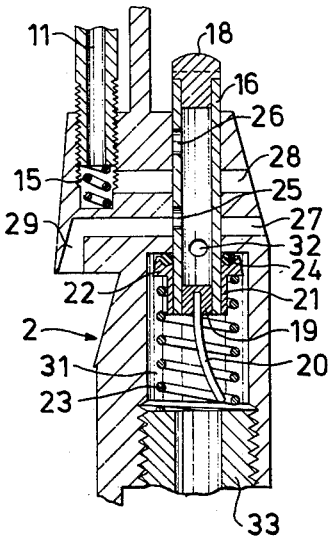

In the drawing:

FIG. 1 is a longitudinal section through the combined suction and blow-off nozzle according to the invention and FIG. 2 is an enlarged detailed section of the valve mechanism of the nozzle.

A combined suction and force nozzle has a substantially tube shaped case 1 including a valve housing 2. Further, the tube shaped case 1 has a venturi nozzle 3 at the rear portion thereof and a flanged portion 4 mounted adjacent the beginning of this nozzle which in turn has a circular groove 5. A bag 7 is attached to the groove 5 by means of an O-shaped ring 6 or a similar means to collect dust or sucked particles of different kinds. The tube shaped case 1 has a cut off portion 9 (shown in dotted lines) at the front end 8 thereof and is provided with a nozzle 10 axially displaceable within the tube portion 8 and made from a plastic or other similar material, whereby preferably the nozzle is obliquely cut at the front end thereof to obtain a suitable working angle especially by the sucking of particles. By making the nozzle 3 of a pliable and flexible material this serves to reduce th noise made by cleaning assemblies. A relatively narrow tube 11 projects from the valve housing 2 parallel to the tube portion 8 but adjacent the upper inner surface thereof, which tube 11 defines an outlet tube for compressed air. The front portion of the tube 11 may be exposed by completely pushing the displaceable nozzle 10 backwardly to the position shown with the dotted line 12, which means that the blowing may also take place in very narrow spaces. The forwardly displacement movement of the nozzle 10 is limited by means of tips 13 punched into the same and co-operating with recesses provided in the tube portion 8 or a conicial turned recess 14. To control the flow of air when the combined suction and blow-off nozzle is used for blowing purposes tube 11 is screw fastened into the valve housing 2 against the action of a coiled spring 15, the compressed air escaping through the coils of said spring. By screwing the tube 11 into valve housing 2 the free area between the coils of the spring 15 is reduced and further the flow of air guided out into the tube 11 is reduced. It is hereby understood that the air flow may be almost completely cut off. The spring 15 also serves as a stop means for the tube 11 so that said tube, especially by maximal output may not be turned by its own action.

To control and guide the air flow a valve mechanism is provided in the valve housing 2, which is best seen in FIG. 2. The main portion of the valve mechanism comprises a tube shaped valve slide means 16 displaceably mounted in an axial bore, which slide means may be set in different positions by means of an operating means 17 (FIG. 1) pivotally mounted on valve housing 2, which is provided with one or more recesses or grooves to prevent turning of the valve slide means. The operating means 17 may also be used as an a suspension hook. The valve slide means 16 is made from a tube closed at both ends by means of plugs 18, 19 pushed into the tube, whereby one plug 18 is operated by the operating means 17 and suitably has a rounded surface for this purpose and, preferably, the second plug is provided to receive a slightly vaulted wire 20 made from a resilient material, which wire serves as a flange when the valve takes the position, in which the nozzle serves as a suction nozzle. A cylindrical part 21 is pressed onto the rear end of the valve slide means 16, which part is provided with a flange 22 partly serving as an anvil for a compression spring 23 acting upon the slide means 16 and also serving as a seal in the closed position of the valve slide means. To accomplish the latter purpose, an O-ring 24 is suitably attached in a corresponding groove, thereby ensuring an effective seal. Further, two radial holes 25, 26 are provided in the valve slide means 16, which holes are intended to communicate with one of the transverse bores 27, 28 of the valve housing 2 in the different positions of the valve slide means. The bore 27 merges into a passage 29 by the remote end relative the valve slide means 16, which passage is parallel to the nozzle and preferably grows wider, whereby the air flows from the rear end thereof when the nozzle is used as a suction nozzle. The bore 28 communicates with the tube 11 mentioned above. Compressed air is fed from the combined suction and blow-off nozzle through a conduit 30 or the like connected to a source of compressed air (not shown) and is fed into the space 31 surrounding the spring 23.

By use of the combined suction and blow-off nozzle according to the present invention the compressed air is fed into the space 31 and by inwardly pressing the operating means 17 the valve slide means 16 opens and permits air to pass the O-ring and into the interior of the tube shaped valve slide means through the passages 32. In operation of the valve slide means to the position in which the resilient wire 20 engages the nipple 33 air flows from the bore 27 via the radial hole 25 and further out through the passage 29 and causes a very effective suction action by means of the ejector action generated and by suitable dimensioning of the venturi nozzle 3. A further pressing the operating means 17 inwards the resilient wire 20 is bent and a somewhat larger force is required to push the operating means 17 to the bottom position thereof, in which the connection between the interior of the valve slide means and the bore 27 is shut off and rather the air is permitted to flow through the radial hole 26 and further outwardly through the tube 11 to accomplish a blowing action for cleaning purposes. Naturally, the invention is not limited to the embodiment described above and shown in the accompanying drawing, but may be varied in several ways within the scope of the following claims.

I claim:

1. A combination suction and air blowing nozzle connectable to a source of compressed air comprising a tube shaped casing having open ends, a venturi nozzle being mounted on one of said casing open ends, a valve housing being mounted on and extending through said casing, said valve housing having a compressed air inlet passage, at least two lateral openings, and a valve bore extending across said lateral openings to said air inlet passage, a tubular slide valve being closed at both ends and slideably extending in said housing valve bore, said slide valve having an opening positioned in a portion of said slide valve for communicating with said housing air inlet passage when said slide valve portion is in said air inlet passage and a pair of side openings each positioned for communicating with one of said valve housing lateral openings when aligned therewith during movement of said slide valve, a tube adjustably mounted in said valve housing in communication with one of said valve housing lateral openings and extending in said casing towards the other end thereof for blowing air out of said casing other end when said tube is adjusted to a position opening its respective valve housing lateral opening and said slide valve is positioned with one of its side openings in communication with said respective valve housing lateral opening and said slide valve first mentioned opening is in communication with said housing air inlet passage, means for moving said slide valve in said valve bore as desired, and said valve housing having a passage communicating with the other of said valve housing lateral openings and extending in said casing towards said venturi nozzle whereby air from said valve housing passage will draw air in said casing other end creating a suction therein when said slide valve is positioned placing said valve housing passage in communication with said valve housing air inlet passage.

2. A combination suction and air blowing nozzle as claimed in claim 1 wherein said tube is in threaded engagement with said valve housing for being adjustably positioned therein.

3. A combination suction and air blowing nozzle as claimed in claim 2 wherein a coil spring is mounted in said valve housing, urging said tube outwardly of said valve housing.

4. A combination suction and air blowing nozzle as claimed in claim 1 including a nozzle slideably mounted on said other end of said casing for being axially displaced thereon.

5. A combination suction and air blowing nozzle as claimed in claim 1 including a bag having an open end positioned around said casing one open end and encasing said venturi nozzle and means detachably retaining said bag open end on said casing.

6. A combination suction and air blowing nozzle as claimed in claim 1 wherein said valve slide has a flange and a spring is mounted in said valve housing air inlet passage and against said flange tending to move said valve slide means outwardly from said air inlet passage.

7. A combination suction and air blowing nozzle as claimed in claim 6 including a resilient wire extending from said valve slide means within said air inlet passage and tending to move said valve slide means from said air inlet passage.

* * * * *